United States Patent [19]

Thomalla

[11] 4,438,526

[45] Mar. 20, 1984

[54] AUTOMATIC VOLUME AND FREQUENCY CONTROLLED SOUND MASKING SYSTEM

[75] Inventor: Richard O. Thomalla, St. Paul, Minn.

[73] Assignee: Conwed Corporation, St. Paul, Minn.

[21] Appl. No.: 372,033

[22] Filed: Apr. 26, 1982

[51] Int. Cl.[3] ..... G10K 11/00

[52] U.S. Cl. ..... 381/73; 179/1.5 M

[58] Field of Search ..... 340/384 E; 381/73, 94; 179/1.5 M, 81 B

[56] References Cited

U.S. PATENT DOCUMENTS 4,052,720 10/1977 McGregor et al. ..... 179/1 P X 4,059,726 11/1977 Watters et al. ..... 179/1 P X

*Primary Examiner*—A. D. Pellinen

*Assistant Examiner*—James L. Dwyer

*Attorney, Agent, or Firm*—Eyre, Mann, Lucas & Just

[57] ABSTRACT

A sound masking system for generating background sound. The background sound is automatically adjusted to ambient noise levels by adjusting the amplitude of the frequency levels detected.

10 Claims, 2 Drawing Figures

POWER AMPLIFIER
28
SPEAKER
30
SUMMING AMPLIFIER
26
DIVIDE CIRCUITS
14
ERROR DETECTING CIRCUITS
24
DETECTORS
22
125 Hz
250 Hz
500 Hz
1000 Hz
2000 Hz
4000 Hz
12
20
AMPLIFIER
18
MICROPHONE
16
RANDOM NOISE SOURCE
10

AUTOMATIC VOLUME AND FREQUENCY CONTROLLED SOUND MASKING SYSTEM

The present invention relates to overcoming open plan architectural space noise problems and more specifically relates to an improved sound masking system.

In recent years, the concept of open plan architectural space has become increasingly popular in office buildings. The popularity of this scheme can be attributed to both the advances in acoustical technology and management's desire to have complete flexibility of floor space as business objectives change.

The open office is distinguished by free standing space dividers and easily-moved work station enclosures which extend only part way to the ceiling and may be rearranged by office maintenance crews. The dividers and work stations define space and act as visual and acoustic barriers.

Because there are no walls which extend from floor to ceiling in this type of open office plan, sound can travel throughout the office and distract office personnel. Many attempts have been made to overcome this problem and maintain the open office plan including the development of better improved ceiling panels, heavy carpets, extensive use of draperies, and the like. Attempts have also been made to generate background noises that "mask" undesired sounds. Such sound masking systems are taught, for example, in U.S. Pat. Nos. 4,024,535 and 4,185,167, both of which are incorporated herein by reference.

A sound masking system attempts to produce a sound field which does not offend the ear, but yet substantially masks unwanted sounds generated in the mythical average office. Some systems in use today permit tuning the loudspeakers in each office to a sound masking field most appropriate for that office. However, once a sound masking system is installed and tuned, any changes in the acoustical environment require that the system be returned to the new environment. If it is not retuned, the benefit of sound masking will be greatly reduced. This can occur frequently since acoustical environments change in the spring and fall as ventilating systems are switched from heating to air conditioning or vice versa.

The acoustical environment in an office will normally also change as the activity in the office increases or decreases. There are some sophisticated sound masking systems that are attached to timing devices which raise or lower the level of sound masking as the day's normal activities increase or decrease.

As was discussed herein above, flexibility of floor space is one of the main objectives of open plan architectural space. Movement of wall partitions and workspaces is common-place and necessary in an open office from time to time. When the use of floor space changes, the acoustical environment also changes. In order to get maximum benefit from the sound masking system, it must be retuned in order to accommodate the existing ambient sound within the office space.

Even in those systems that are retunable, retuning is not frequent because it is both expensive and inconvenient. The amplitude and frequency spectrum in each room must be measured, and the system filters and gain must be adjusted accordingly. Technicians adjust the filters until, by trial and error method, the measurements approach those which they have found to be desirable. This process often takes two technicians several hours to perform.

The applicant has now discovered that sound masking systems can be substantially improved by including means for adjusting the amplitude and frequency spectrum levels emitted by the sound masking means as the acoustical environment changes. This is accomplished through the use of at least one sound sensing means which supplies feedback information to the system. This feedback information is then processed by the system to adjust the amplitude and frequency spectrum being emitted by the sound making means. This is suitably accomplished by comparing the feedback with a standard amplitude and frequency spectrum.

Figure 1:
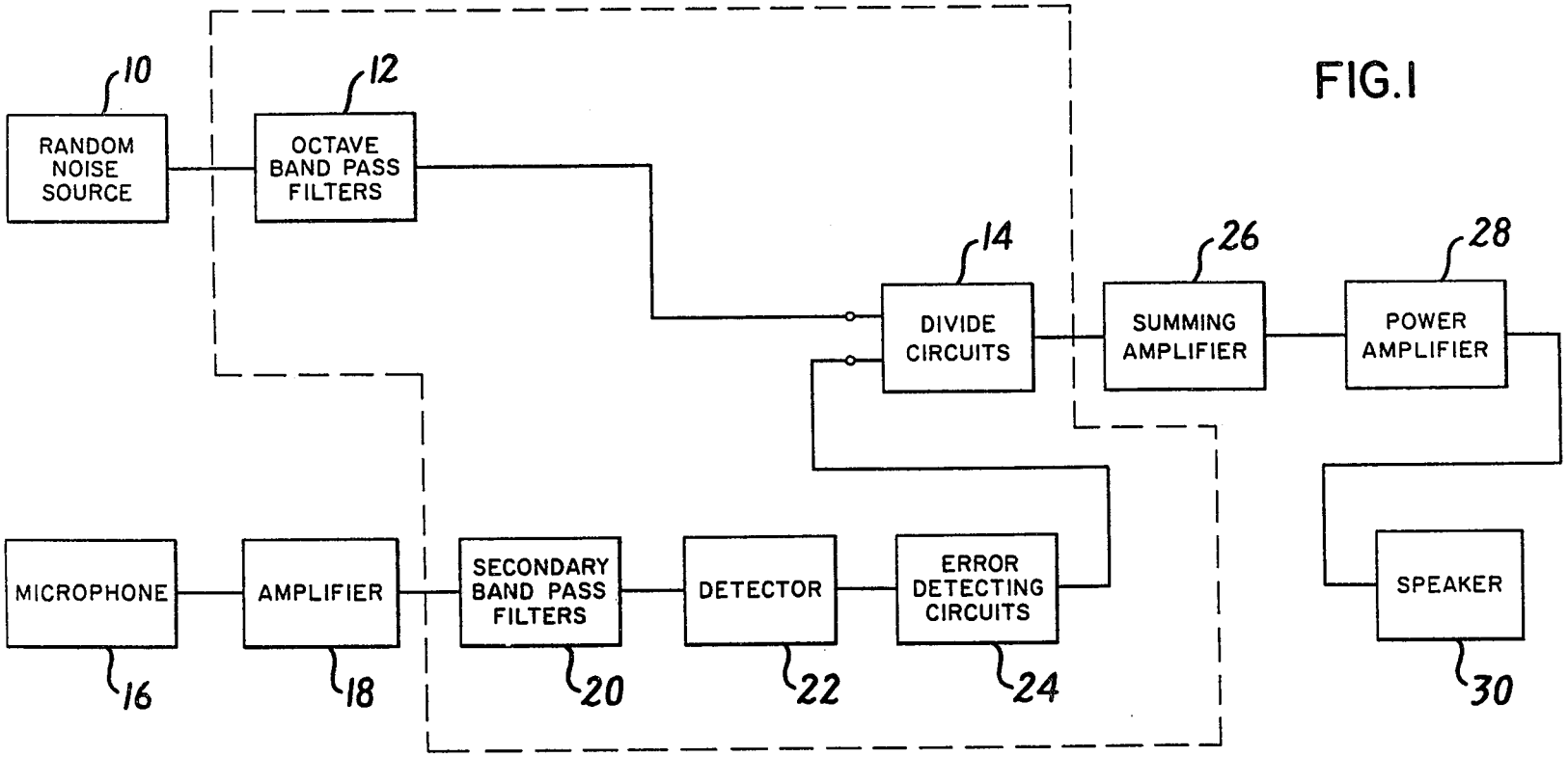
FIG. 1 is a block diagram of one embodiment of the applicant's invention including an automatic amplitude and frequency controlled sound masking system.

As shown in FIG. 1 a random noise source 10 is connected to a plurality of primary filters 12, preferably octave band pass filters of known construction. There are a predetermined number of these filters each of which has a preselected, different band pass midpoint. Each filter 12 is connected to a conventional divide circuit 14. The outputs from the filters 12 are operated on as dividends by the divide circuit 14.

At least one microphone 16 senses the sound emanating from the acoustical environment, e.g. the sounds generated in a typical business office. The microphone 16 is connected to an input amplifier 18 which provides suitable gain to the signal.

The output of the amplifier 18 is connected to a plurality of secondary band pass filters 20 which are duplicates of the primary filters 12. Any number of these secondary filters with appropriate band pass midpoints can be used in this type of system. The primary and secondary filters may have either digital or analog circuitry.

The secondary filters 20 are connected to a plurality of detectors 22. It is preferred that each filter be connected to a separate detector. The detector generates a signal which preferably corresponds to an average level of the amplified and filtered microphone pickup.

The detectors 22 are connected to a plurality of conventional error detecting circuits 24. In the example there are detecting circuits which are individually matched with each of the detectors. Each of these error-detecting circuits has a preset reference voltage. This preset voltage is adjusted to provide a predetermined DC output and thus a predetermined background noise level when the room is otherwise quiet.

The output signal of the error-detecting circuits 24 are connected to the divide circuits 14. This output signal is the denominator for the divide circuit.

In order to avoid sudden and short changes in the noise generators, as occasioned for example by a clapping of hands, the error-detecting circuit preferably does not reflect a change in the error-detecting output signal unless the input signal has a duration of more than a predetermined lag time, e.g. 30 seconds.

The divide circuits 14 are connected to a summing amplifier 26. The summing amplifier 26 is connected to at least output amplifier 28 of suitable gain to drive at least one output transducer 30, e.g. a loudspeaker.

Figure 2:
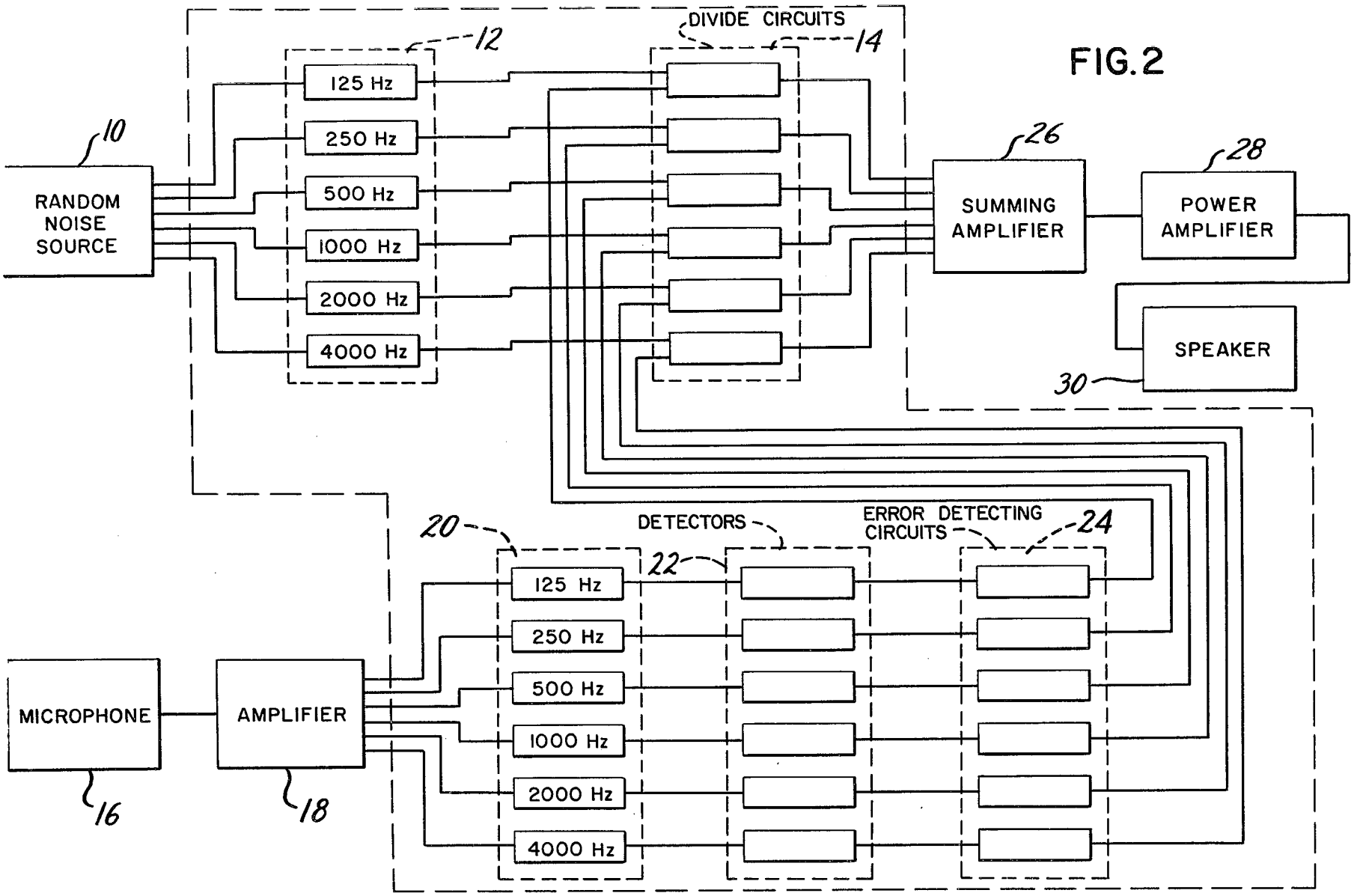
FIG. 2 is a block diagram of a preferred embodiment of the applicant's invention.

A preferred embodiment of the present invention includes the following items in the system just described and is illustrated in FIG. 2:

(a) The number of primary filters 12 is at least six as shown with each band pass midpoint being a multiple of the one below it and with the first one having a band pass midpoint of 100–150 Hertz, e.g. about 125 Hertz, the second at about 250 Hertz, the third at about 500 Hertz, and so forth for 1000 Hertz, 2000 Hertz, and 4000 Hertz.

(b) There is a divide circuit 14 for each primary filter with the divide circuits being connected to a summing amplifier 26.

(c) There is at least one microphone 16 and, for each microphone, amplification means 18.

(d) The number and band pass midpoints of the secondary filters 20 is the same as the primary filters 12.

(e) There is one detector circuit 22 for each secondary filter and one error-detecting circuit 24 for each detector 22.

(f) The error-detecting circuits 24 have a preset reference voltage of at least about 1 volt DC output.

(g) The error-detecting circuit 24 includes a time delay so that its output signal to the divide circuit 14 does not change unless the change in the input signal has a predetermined duration of at least about 30 seconds.

(h) There is at least one loudspeaker 30 and, for each loudspeaker, an output amplification means 28.

An even better system than that just described is one with an increased number of filters, both primary and secondary, and a corresponding increased number of associated components, e.g. dividers, detector circuits, etc. Since it has been found that there is no great benefit in going below about 100 hertz or above about 6000 hertz, the additional filters should fall within the 100–6000 hertz range. It has been found that it is desirable to have each filter an approximate multiple of a lower filter; however, there can be a plurality of lower filters. These lower filters are generally in the 100–200 hertz range. For example, if the lower filters are 125, 160 and 200 hertz, then a preferred system would include filters having the following band pass midpoints:

| | | |
|---|---|---|
| 125 Hertz | 160 Hertz | 200 Hertz |
| 250 Hertz | 315 Hertz | 400 Hertz |
| 500 Hertz | 630 Hertz | 800 Hertz |
| 1000 Hertz | 1250 Hertz | 1650 Hertz |
| 2000 Hertz | 2500 Hertz | 3200 Hertz |
| 4000 Hertz | 5000 Hertz | |

The operation of the system is described below. The random noise source 10 provides a noise signal having a predetermined noise spectrum, that is, a noise signal having a frequency component distributed throughout a predetermined range of audible frequencies. This signal is provided to each of the primary filters 12. The output of each filter 12 is a filtered noise signal comprising a band of frequencies centered about the predetermined midpoint frequency of the filter. The output signal from each filter is fed as the dividend to a conventional divide circuit 14.

Microphone 16 senses the ambient sounds in the environment and converts the noise to a signal which is amplified by the amplifier 18 and fed to each of the secondary band pass filters 20, which preferably are duplicates of primary filters 12. Thus, the noise level of the environment is filtered into the same frequency components as provided in the filtered random noise spectrum.

Each of the secondary filters 20 feeds its output signal to a detector 22 which in turn provides a signal corresponding to an average level of the ambient sound level in the appropriate band frequencies. The output of the detectors 22 are connected to a plurality of error-detecting circuits 24 which match the signal level input to a predetermined standard signal level to develop an error signal. The error signal is then fed as the divisor input to the divide circuits 14.

For a quiet room, the error signal is adjusted to correspond to a divisor signal of the unity so that the signal from the primary filters 12 are passed essentially unchanged by the divide circuits 14 to the summing amplifier 26. It will be appreciated that the amplitude of the signal in each bank of frequencies may be suitably adjusted to provide a predetermined volume level of each frequency band throughout the frequency spectrum.

As the noise changes in the environment, the microphone senses the sound level and the signal levels at the particular frequencies filtered through the secondary filters also change. The change in amplitude of the signal output from detectors 22 is matched with the standard in the error-detecting circuits 24. After a predetermined lag time, suitably 30 seconds or more, the error-detecting circuit responds by varying its output signal level in correspondence with the change in detected signal level. The change which occurs in any particular frequency band thus changes the amplitude at the divisor input of the divide circuit. The output signal from the divide circuits will thus change up or down in amplitude in accordance with the monitored sound intensity at each frequency band in the environment, thus automatically assuring that the output signal to the loudspeaker of the sound masking system will at all times provide the desirable volume from the loudspeaker throughout the frequency spectrum.

It will be understood that the preferred embodiments described hereinbefore were selected as the best mode contemplated by the inventor and that the claims are intended to cover all changes and modifications of the preferred embodiments which do not depart from the spirit and scope of the invention.

What is claimed is:

1. A sound masking system comprising means for generating a random noise spectrum; means for separating the random noise spectrum into generated signal components of predetermined frequencies; a plurality of adjustment means, each said adjustment means receiving a first signal component from among said generated signal components; amplification means, said amplification means receiving an output from said adjusting means for driving a sound generating means in correspondence with said output; means for generating at least one sensed signal corresponding to sounds sensed in the ambient sound environment of said sound masking system; means for separating said sensed signal into predetermined frequency components thereof; means for feeding an error signal in correspondence with said sensed signal to the adjusting means, whereby said adjusting means varies the output to said amplification means for automatically adjusting the volume of the sound masking system.

2. A sound masking system comprising means for generating a random noise spectrum; a plurality of primary filters for separating the random noise spectrum into signal components of predetermined frequencies; a plurality of divide circuits, each said divide circuit being operative for receiving an associated signal component from among said signal components at a divide input port thereof; amplification means, said amplification means receiving an output from said divide circuits for driving a sound generating means in correspondence with said output; at least one microphone for sensing sounds in the ambient sound environment and providing an electronic signal in correspondence therewith; an input amplifier for amplifying said electronic signal; a plurality of secondary filters for receiving the amplified electronic signal and separating said electronic signal into predetermined frequency components thereof; said secondary filter providing input signals to a plurality of electronic detector circuits; said plurality of error-detecting circuits operative for receiving signals from said electronic detector circuits and feeding an error signal in correspondence with the output of said detector circuits to the denominator input ports of said plurality of divide circuits, whereby said divide circuits vary the output amplitude of said signal components to said amplification means for automatically adjusting the volume of the sound masking system throughout the frequency spectrum thereof.

3. The system of claim 2 wherein the number of primary filters is at least six with each band pass midpoint being a multiple of the one below it and with the first one having a band pass midpoint of 100–150 Hertz.

4. The system of claim 3 wherein:

(a) the band pass midpoint of the first primary filter is at about 125 Hertz, the second at about 250 Hertz, the third at about 500 Hertz, and so forth for 1000 Hertz, 2000 Hertz, and 4000 Hertz;

(b) there is a divide circuit for each primary filter;

(c) there is at least one microphone and, for each microphone, amplification means;

(d) the number and band-pass midpoints of the secondary filters is the same as the primary filters;

(e) there is one detector circuit for each secondary filter and one error-detecting circuit for each detector; and (f) there is at least one loudspeaker and for each loudspeaker an output amplification means.

5. The system of claim 2 wherein the error-detecting circuit includes a time delay so that its output signal does not change unless the change in the input signal has a predetermined duration of at least about 30 seconds.

6. The system of claim 2 wherein there are a plurality of filters in the 100–200 Hertz range.

7. The system of claim 6 wherein there are a plurality of filters in the range of from about 100 to about 6000 Hertz, the midpoint frequency of each of said filters being an approximate multiple of one of said filters in the 100–200 Hertz range.

8. The system of claim 7 wherein the filters have band-pass midpoints of about:

| | | |
|---|---|---|
| 125 Hz. | 160 Hz. | 200 Hz. |
| 250 Hz. | 315 Hz. | 400 Hz. |
| 500 Hz. | 630 Hz. | 800 Hz. |
| 1000 Hz. | 1250 Hz. | 1600 Hz. |
| 2000 Hz. | 2500 Hz. | 3200 Hz. |
| 4000 Hz. | 5000 Hz. | |

9. An electronic circuit comprising:

(a) means for receiving a signal from a noise source generating means;

(b) means for separating the noise source signal into spectral components of various frequencies;

(c) means for receiving a signal from sensing generation means;

(d) means for separating the signal from the sensing generation means into spectral components of various frequencies;

(e) signal processing means wherein the noise source signal frequency components and the sensing generation means frequency components are compared and an output signal is generated based on the differences in the signals;

(f) means for amplifying the output of the signal processing means to drive a sound generation means.

10. A method of automatically adjusting a sound masking system which provides a noise input to a loudspeaker for masking noise in the environment comprising the steps of:

(a) generating a random noise having a predetermined frequency spectrum;

(b) filtering the noise spectrum into components of various frequencies for outputting as an audible sound from a loudspeaker;

(c) sensing the ambient sound environment;

(d) filtering the sensed noise of the environment into components of various frequencies, said components matching the components in the filtered random noise spectrum;

(e) adjusting the output component amplified at each frequency in accordance with the measured level of the sound environment at each particular frequency.

* * * * *